United States Patent [19]

Hawkins

[11] Patent Number: 4,493,013

[45] Date of Patent: Jan. 8, 1985

[54] SHATTER-PROOF LIGHTING FIXTURE

[76] Inventor: Kenneth R. Hawkins, 32738 River Rd., Gurnee, Ill. 60031

[21] Appl. No.: 466,001

[22] Filed: Feb. 14, 1983

[51] Int. Cl.[3] ..... F21V 7/00

[52] U.S. Cl. ..... 362/307; 362/216; 362/217; 362/224; 362/240; 362/246; 362/248; 362/260; 362/328; 362/329; 362/347; 362/362; 362/368

[58] Field of Search ..... 362/217, 223, 260, 330, 362/362, 367, 307, 224, 240, 246, 248, 328, 329, 347, 368

[56] References Cited

U.S. PATENT DOCUMENTS 4,312,028 1/1982 Hamacher ..... 362/217

4,412,276 10/1983 Blinow ..... 362/223

*Primary Examiner*—Donald P. Walsh

*Attorney, Agent, or Firm*—Michael G. Berkman

[57] ABSTRACT

A lighting fixture having a dish-shaped chassis which houses lighting elements including tube sockets, transformers, and ancillary electrical components. The chassis is sleeved within a protective, unitary, shatter-proof plastic closure shell having opaque, marginally disposed panel sections and an opaque circumscribing wall assembly integrally formed with and substending a light-transmitting diffuser lens bounded by a transversely extending, integrally-formed light-transmitting frame. The opaque panel sections shield the chassis-housed tube sockets and transformers from view exteriorly of the fixture.

5 Claims, 11 Drawing Figures

FIG-1
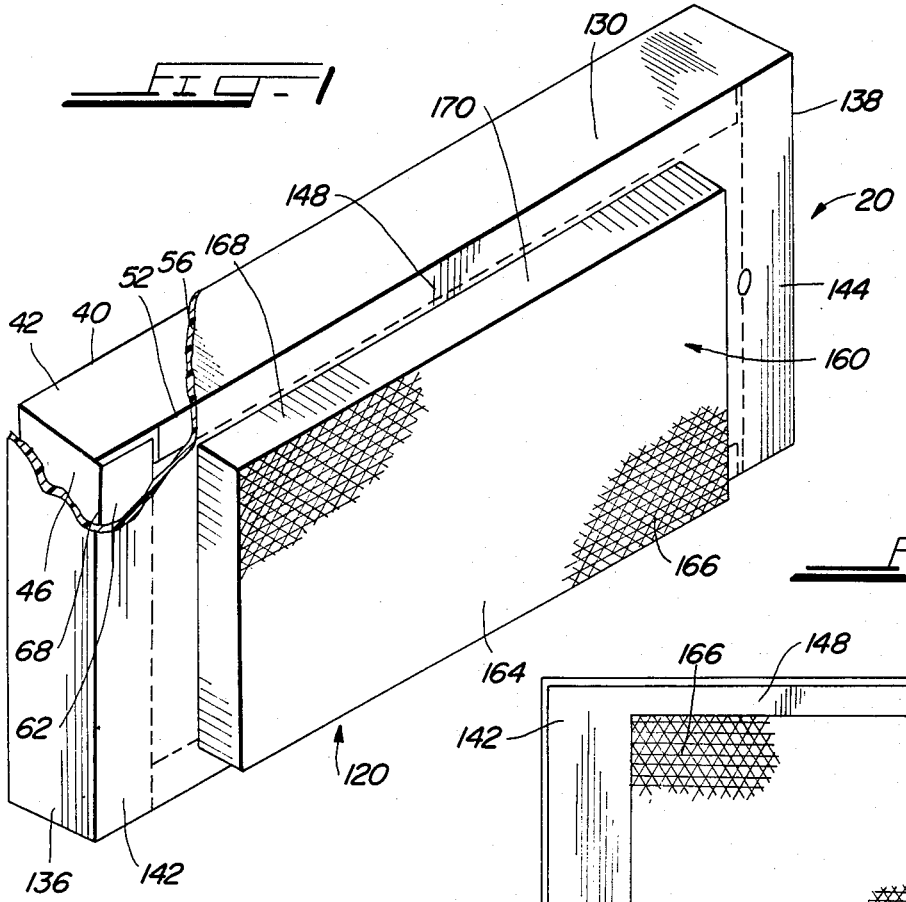
FIG-2
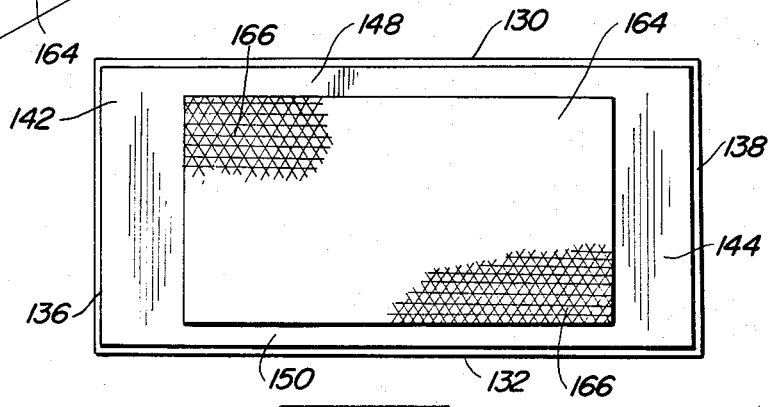
FIG-4
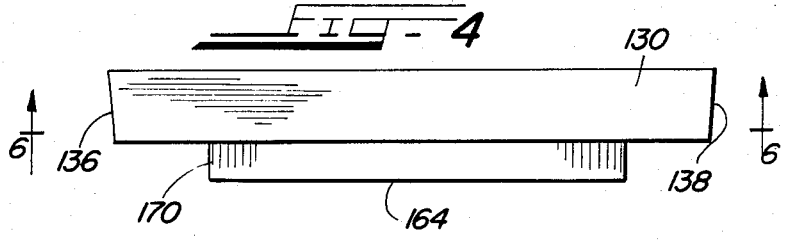
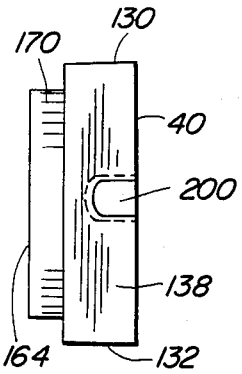
FIG-3
FIG-5
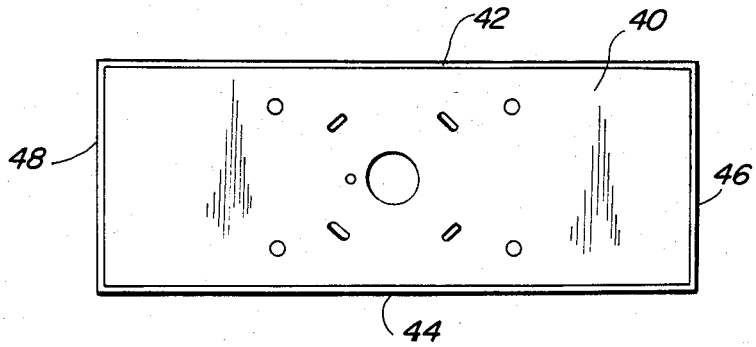

SHATTER-PROOF LIGHTING FIXTURE

BACKGROUND OF THE INVENTION

The present invention relates generally to electrical fixtures. More particularly, the invention is directed to a relatively small, multi-purpose fluorescent lighting fixture of the wall or soffet-mounted type.

Many different types and styles of fluorescent fixtures are known in the prior art. These have taken various structural forms, have utilized various fabrication materials and techniques, and have contemplated various general as well as special applications. Developments and improvements in this broad area of interest have been exceedingly diverse, encompassing louvre grids and lens features, housing and troffer construction, mounting and leveling devices, closure mechanisms, and, additionally, internal electrical circuitry, including the illumination elements themselves.

In spite of the extensive development work conducted and the intense and protracted engineering programs of the past, significant problems persist. These problems have not, heretofore, been solved satisfactorily. This is true particularly in the sphere of relatively small fluorescent lighting fixtures of the type which are unavoidably located so as to be readily physically "accessible" to the public. It has been found that such fixtures call for unusual durability including resistance to misuse and to physical mistreatment. Such fixtures must be highly resistant to breakage, and must be easily serviced. At the same time, it is desirable that the fixtures be aesthetically pleasing and compatible with diverse decors and interior decoration.

It is to the effective resolution of these and other challenges posed and to obviating shortcomings and inadequacies of prior art lighting structures that the present invention is directed. A principal aim of the present invention is to provide a simple yet well conceived, effective, and practical lighting fixture obviating many of the deficiencies which presently plague the manufactures and the users of such devices.

SUMMARY OF THE INVENTION

An important feature of the present invention is that the improved lighting fixture utilizes a minimum number of component parts, thereby simplifying initial construction, maintenance and repair.

A related feature and advantage of the lighting fixture of the present invention is that it includes an internal reflector which is mountable within and secured in place without any requirement for tools or for auxiliary, separate fasteners.

Yet another feature of the fixture of the invention contributing to its practicality is a physical arrangement in which the chassis which houses the electrical components of the device is capped by a closure consisting of a protective plastic shell. The protective shell or sleeve is unitary with a light-transmitting lens plate or diffuser.

Still another advantage of the invention is that the lens subtends from the body of the closure shell. A perimetric wall, which is normal to and surrounds the lens element, also transmits illumination.

A related feature of the invention is that the closure shell of the fixture includes light-opaque panels which overlie electrical components mounted in the housing of the fixture to shield or block such components from view.

An important structural advantage of the fixture of the invention is that the shell including the integrally formed lens plate and associated supporting panels and walls is of a unitary highly transparent plastic construction providing enhanced light transmission.

A related advantageous feature of the invention is that the unitary shell and lens assembly is fabricated of a shock and shatter-resistant plastic material.

It is a feature of the fixture of the invention that the chassis and the reflector are fabricated of heat dissipating sheet metal, such as aluminum, to obviate overheating and thus contributing to longer useful life for the electrical components and the fixture itself.

Other and further features and advantages of the invention will be evident upon a reading of the following detailed description considered in conjunction with the drawings.

BRIEF DESCRIPTION OF THE DRAWINGS

FIG. 1 is a perspective view with parts broken away, of a lighting fixture, according to the invention;

FIG. 2 is a front elevational view showing the oversleeved combination opaque fixture shell, and integrally formed combination diffusing lens and illuminating perimetric skirt;

FIG. 3 is an end view of the fixture showing the unitary combination opaque shell and light transmitting skirt, and an optional fixture-mounting knock-out;

FIG. 4 is a top plan view of the fixture showing the unitary housing-enveloping plastic shell including the integrally formed light-transmitting skirt;

FIG. 5 is a rear elevational view showing the rear wall of the chassis of the fixture;

DESCRIPTION OF THE PREFERRED EMBODIMENT

In effectuating the aims and purposes of the present invention, the structure of the fluorescent fixture embodies three principal components—a chassis or housing, a reflector sheet or trough, and a shell or closure. The latter includes a subtended integrally formed lens assembly, the combination shell and lens assembly being fabricated of high strength, impact resistant and essentially "unbreakable," shatter-proof molded plastic, preferably polycarbonate (e.g. LEXAN®). The shell envelopes the housing and seals access thereto.

Figure 6:
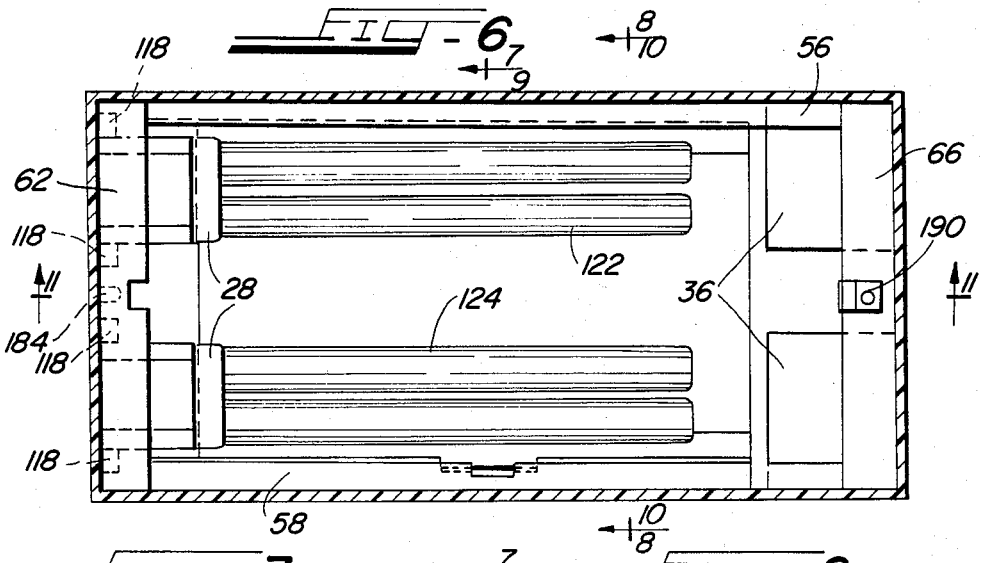
FIG. 6 is a front elevational view of the fixture with the lens-carrying cover shell assembly removed to show the arrangement of elements within the fixture housing, including the light reflector, and also showing the fluorescent tubes, mounting sockets and transformer elements.
Figure 7:
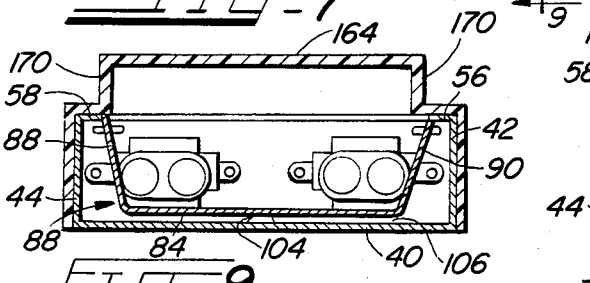
FIG. 7 is a cross-sectional view taken substantially on the lines 7—7 of FIG. 6 and showing the socket-mounted fluorescent tubes and the trough-shaped, snap-in reflector.
Figure 8:
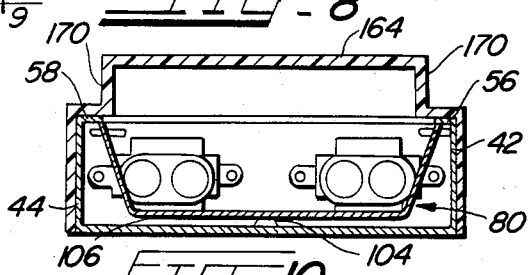
FIG. 8 is a cross-sectional view taken substantially on the lines 8—8 of FIG. 6.
Figure 9:
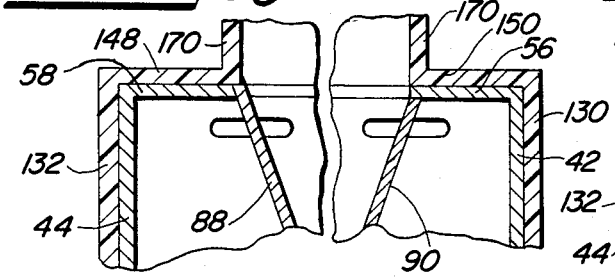
FIG. 9 is an enlarged, fragmentary cross sectional view taken substantially on the lines 9—9 of FIG. 6 and showing the reflector arrangement in the chassis of the fixture.

Referring more particularly to the drawings, and specifically to FIGS. 1, 3 and 6, for purposes of disclosure and not in any limiting sense, one preferred embodiment of the fluorescent lighting fixture 20 of the invention is shown as a generally rectangular, modified, box-like configuration. An open-top, pan-like chassis 24 serves as a housing for electrical circuit elements including fluorescent lamps 28, lamp sockets or holders 32 and transformers 36. None of these elements, per se, constitutes a part of the present invention as such. In the illustrative example shown, the chassis 24 has a base, bottom, or rear wall 40, a pair of side walls 42 and 44 and a pair of opposed end walls 46 and 48. Overall, the exemplary fixture 20 is 10½ inches long, 5 inches wide and 2 inches deep. The dimensions of the fixture 20 are not critical. Rather, they are dictated by the ultimate intended use or functional application contemplated.

Figure 10:
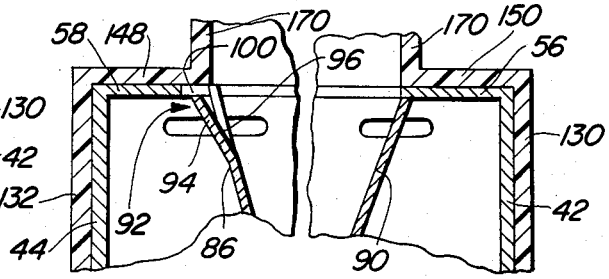
FIG. 10 is an enlarged, fragmentary cross-sectional view taken substantially on the lines 10—10 of FIG. 6 and showing the manner in which the reflector is held in place in the chassis of the fixture.

Integrally formed with and extending inwardly and normally from opposed side walls 42 and 44 at forwardly presented ends 52 and 54 thereof are flanges 56 and 58, which, together with similar flanges 62 and 66 projecting inwardly of top edges 68 and 72 of opposed end walls 46 and 48 frame the entry 76 to the chassis 24. The chassis 24, which is preferably formed of aluminum sheet material from a unitary blank provides enhanced heat dissipation. An aluminum snap-in reflector 80 generally trough-shaped with one end open and the opposite end having a wall 82 surmounted by an outwardly extending flange 84 consists of a principal panel or floor 86 and a pair of upwardly extending, outwardly flared side walls 86 and 90. Nested within the chassis 24, the reflector 80 is retained secured by means of an integral snap fastener 92 in the form of a slot-framed tongue 94 bent downwardly to project outwardly from a top marginal portion 96 of the reflector side wall 88. The tongue 94 snaps under an edge 100 of a flange 58 of the chassis 24, as indicated in FIG. 10.

The opposite wall 90 of the reflector 80 is restrained under the corresponding framing flange 56 of the chassis 24. The floor or base 84 of the reflector 80 is urged in stressed, tensioned abutment against a spacer-like dimple or stop 104 embossed to project upwardly of the rear wall 40 of the chassis 24 so that a heat-dissipating air-circulation passage 106 is established between the chassis 24 and the reflector 80.

A pair of lamp sockets 32 fastened 118 to an end wall 46 of the chassis 24 support the fluorescent tubes or lamps 28. The latter are preferably PL Series (Norelco®) low-voltage type lamps with an output efficiency of about 65 lumens per watt. Suitable transformer units 36 are wall-mounted at the opposite end of the assembly. Wiring and connections, not shown, complete the electrical configuration.

An important mechanical structure contributing to the general utility, the enhanced safety, and the extended useful life of the lighting fixture of the invention is the provision of a unique one-piece injection molded combination cover or closure and lens assembly 120. In the preferred embodiment of the invention illustrated, the combination closure and lens assembly 120 is a generally dish-shaped, injection-molded unit having opposed side walls 130 and 132 and interconnecting end walls 136 and 138, all defining a perimetric sleeve sized to circumscribe and slidably to receive therewithin the metal chassis 24, the walls 42, 44, 46 and 48 of the latter nesting within and adjacent to corresponding walls 130, 132, 136 and 138 of the plastic closure 120.

Integral with and extending generally normally to and inwardly of the walls 130, 132, 136 and 138 of the closure 120 are two opaque, wing-like end panels 142 and 144 and a pair of spaced, parallelly extending opaque side flanges 148 and 150 bridging between the end panels, in the same plane therewith. Inwardly presented edges of the end panels 142 and 144 and the side flanges 148 and 150 define a frame delineating a window-like opening. A preferred method of rendering the end panels and flanges opaque is to enamel the inside or under surface.

Set in as an integrally-formed outward-extending projection from the frame is a lens or light diffusing or illuminating assembly 160. In the preferred embodiment of the fixture shown, the illuminating assembly 160 consists of a light transmitting lens plate 164 which is internally prismatically patterned 166. A transparent, fluid 168 skirt-like wall 170 integrally formed with and encircling the plate 164 connects the illuminating portions of the assembly 120 to the end panels 142 and 144 and the side flanges 148 and 150 to provide a unitary structure from which light is transmitted downwardly or outwardly through the lens plate 164 and laterally (or normally to the light emanating from the lens plate) through the skirt-like fluted wall 170. The arrangement described not only contributes to the practicality and versatility of the fixture in use, but also to design characteristics and features which are most pleasing from an aesthetic point of view.

A very important practical feature of the lighting fixture of the invention is that in a preferred embodiment, the combination housing and lens assembly is molded from ultra violet-irradiation-stablized polycarbonate resin. In addition to the superior optical properties of the resulting assembly, the latter, which is uniquely fracture-proof and shatter-proof, completely encloses the entire fixture in a protective shell-like casing which is essentially "vandal-resistant" to obviate "casual" damage.

Any suitable method may be used to retain the plastic housing closure-lens assembly 120 sleeved over and in place on the metal chassis 24. In the specific preferred structure depicted, securment is effected by means of an interlock key in combination with a screw. A boss or stud 180 integrally formed with a projection extending inwardly from an end wall 136 of the plastic shell 120 projects through to seat within a prepunched hole or opening 184 formed in an end wall 46 of the chassis 24. At the opposite end of the plastic closure 120, the end panel 144, which overlies the end wall flange 66 of the chassis 24, is formed with a screw hole 186 which is in registry with a screw-receiving opening or fitted opening 190 in which a securement screw 192 is received and lockingly engaged.

Figure 11:
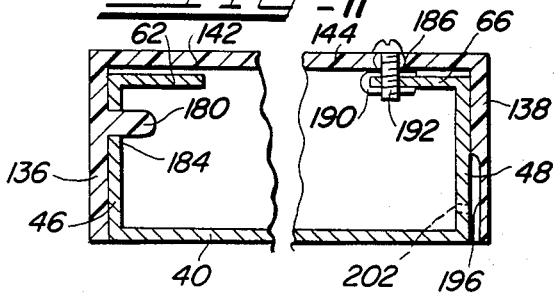
FIG. 11 is a fragmentary, cross-sectional view taken substantially on the lines 11—11 of FIG. 6 and showing the manner in which the plastic shell of the fixture is retained in place on the metal chassis.

In a second, alternative, embodiment of the invention, a somewhat modified interlock system is used to hold the plastic shell 120 in place on the chassis 24. Instead of a screw hole in the face of the end panel 144 of the shell 120, the shell is provided with a thinned zone 200, providing a knock-out on an end wall 138 opposite the wall 136 which carries the interlock stud 180, and the end wall 48 of the metal chassis 24 is predrilled to provide a screw-receiving hole 202 (FIGS. 3 and 11).

What is claimed is:

1. A lighting fixture comprising a unitary lamp housing and light-transmitting lens assembly fabricated of molded plastic, said lens assembly comprising a generally dish-shaped pan including a diffuser plate and circumambient light-transmitting walls, said walls framing said plate and extending inwardly from and generally normally thereto, a pair of opaque, wing-like panels displaced rearwardly with respect to said diffuser plate, said panels being integrally connected to and projecting from a corresponding pair of parallely extending inward edge portions of two opposed said walls framing said plate, said panels extending generally normally of said walls and in a panel paralleling said diffuser plate, an endless, opaque perimetric wall circumscribing said pan and said panels connected thereto, said wall being normal to a light-transmitting face of said diffuser plate, an open-face chassis serving as a receptacle for lamps, lamp-holding sockets secured therewithin and ancillary electrical apparatus including circuit wiring, said chassis having a rear principal face and a bounding circumambient wall and being sized for insertion slidably, wall first, into said housing and sleevingly to nest therewithin with said bounding wall of said chassis disposed interiorly of and in substantially contiguous abutment with said perimetric wall of said housing, and generally trough-shaped, concave, removable reflector means of preformed self-sustaining shape for focusing and for intensifying illuminating light emanating from lighted lamps of said fixture, retention means carried by and integral respectively with said chassis and with said reflector means for removably securing said reflector means functionally within said chassis to facilitate assembly of said fixture.

2. The structure as set forth in claim 1 and further comprising a plurality of spaced, dimple-like, outwardly-directed deformations formed in said rearface of said chassis and projecting toward to abut said reflector means on an undersurface thereof, said deformations constituting upstanding spacer means to support said trough-like reflector means spaced from an inner surface of said rearface of said chassis to provide an air circulation and wire passage channel therebetween.

3. The structure as set forth in claim 1 wherein said opaque wing-like panels comprise optical shields to obviate objectionable display of essential functional electrical components housed in said lighting fixture and positioned at opposed end portions of said chassis, said shields serving thereby to enhance overall appearance and aesthetic appeal of said fixture.

4. The structure as set forth in claim 1 wherein said retention means comprises cooperating intercoupling means integrally formed at corresponding positions at opposedly presented edge portions of respective said reflector means and a segment of said circumambient wall of said chassis for releasibly interlocking said reflector in place within said chassis.

5. The structure as set forth in claim 1 and further comprising a blind, knock-out section in said perimetric wall of said pan, said knock-out section being in overlying registration with a preformed screw hole in said circumambient wall of said chassis, said knock-out section being physically forcibly removable to expose the screw hole and to provide screw access thereto for removably fastening said housing to said chassis.

* * * * *